United States Patent [19]

Flodin

[11] 4,262,572

[45] Apr. 21, 1981

[54] LOG SAWING APPARATUS

[76] Inventor: Larry M. Flodin, Box 80-528, Fairbanks, Ak. 99709

[21] Appl. No.: 100,939

[22] Filed: Dec. 6, 1979

[51] Int. Cl.[3] ..... B27B 7/02

[52] U.S. Cl. ..... 83/471.2; 83/488; 83/704; 83/708; 83/522; 144/312

[58] Field of Search ..... 83/704, 708, 471.2, 83/488, 522; 144/312

[56] References Cited

U.S. PATENT DOCUMENTS

| | | | |
|---|---|---|---|
| 1,842,114 | 1/1932 | Pratt | 83/488 |
| 2,254,293 | 9/1941 | Kaehlert | 83/488 R |
| 2,806,492 | 9/1957 | Becker | 83/522 |
| 3,368,597 | 2/1968 | Carter | 83/522 |
| 3,448,780 | 6/1969 | Hervey | 83/704 |
| 3,718,063 | 2/1973 | Meis | 83/471.2 |
| 3,729,265 | 4/1973 | Carter et al. | 83/522X |
| 3,747,457 | 7/1973 | Thompson | 83/471.2 |
| 4,067,368 | 1/1978 | Beecroft | 83/488 X |
| 4,068,695 | 1/1978 | Seaman | 144/312 |
| 4,078,460 | 3/1978 | Bowman | 83/488 X |
| 4,104,944 | 8/1978 | Janssen | 83/471.2 |
| 4,148,344 | 4/1979 | Critchell et al. | 83/471.2 X |

*Primary Examiner*—Donald R. Schran

*Attorney, Agent, or Firm*—Wells, St. John & Roberts

[57] ABSTRACT

A log sawing apparatus is described for enabling a single person to control the sawing operation at a single log sawing station. The apparatus includes means for prealigning the log with respect to a projected grid in a first plane. After being prealigned, the log is transferred to the log sawing station where the log is held stationary. A saw carriage with a main saw thereon moves past the log sawing station to cut the log lengthwise. The log is held stationary by a log holding means that may be moved laterally to progressively feed the log laterally with the sawing plane. Log rotating means is provided at the log sawing station to rotate the log 90° or 180° to progressively present various log sides to the sawing plane. Additionally, a second alignment means is provided to align the log with respect to a second grid pattern to align the log in a second plane normal to the first plane.

15 Claims, 18 Drawing Figures

10
12
16
18
22
24
26
32
36a
36b
36c
40
44
46
48
49
58
62
67
69
71
73
76
80
84
86
88
92
93
96
112
116
118
122
124
130
133
135
136
138
155
176
178
180
"A"
"B"
"D"

"A"

200
1
4
92
3
"E"
2
93
"A"

201
3
2
92
1
E
4
93
"A"

202
2
92
3
1
204
"E"
203
4
93
"A"

1
92
2
"E"
4
205
3
93
"A"

206
1
92
2
"E"
4
208
207
3
93
"A"

3
92
4
"E"
2
209
1
93
"A"

92
"E"
93
210
"A"

92
"E"
211
212
93

3
204
12
210
208
4
2
211
1
212

LOG SAWING APPARATUS

BACKGROUND OF THE INVENTION

This invention relates to wood sawing apparatus for sawing logs into one or more timbers.

In recent years there has been a large increase in the cost of logs and it is becoming more and more an economic necessity to obtain the maximum usable structural wood from each log. Sophisticated large lumber mills have been developed in which the logs are passed longitudinally through automatic profile scanning equipment to program the sawing cuts as the log is sequentially processed through the mill to obtain maximum utilization.

Because of the large capital cost associated with automatic profile scanning equipment, it has been difficult for small lumber mills to obtain maximum structure wood from each log. Consequently, it has become more and more difficult for a small lumer mill to be competitive with the large lumber mills that have very sophisticated and costly automatic scanning equipment.

The principal object of this invention is to provide a very low cost lumber mill that is capable of obtaining maximum log utilization with a minimum of personnel and without large capital expenditure for automatic profile scanning equipment.

A further object of this invention is to provide a lumber mill in which a single person is capable of controlling the entire cutting operation.

These and other objects and advantages of this invention will become apparent upon reading the following detailed description of a preferred embodiment.

BRIEF DESCRIPTION OF THE DRAWINGS

A preferred embodiment of this invention is illustrated in the accompanying drawings, in which.

DETAILED DESCRIPTION OF A PREFERRED EMBODIMENT

Figure 1:
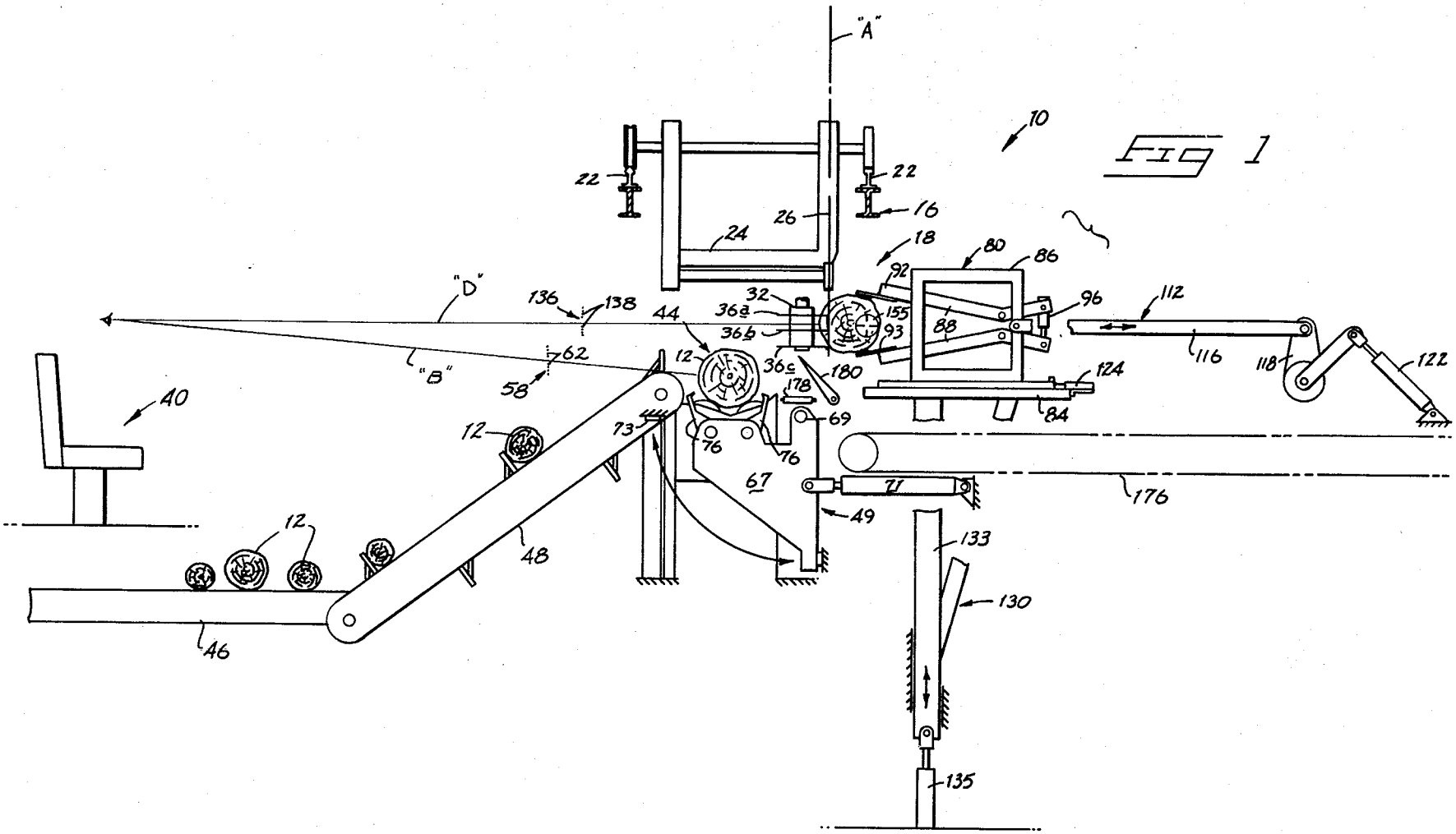
FIG. 1 is a side schematic view of a log sawing apparatus that is the subject of this invention.

Referring to the drawings, there is illustrated in schematic view in FIG. 1 a log sawing apparatus that is generally designated with the numeral 10. The apparatus 10 is designed to cut an elongated log 12 between log ends 13 and 14 into two or more timbers and preferably into a plurality of boards.

Figure 7:
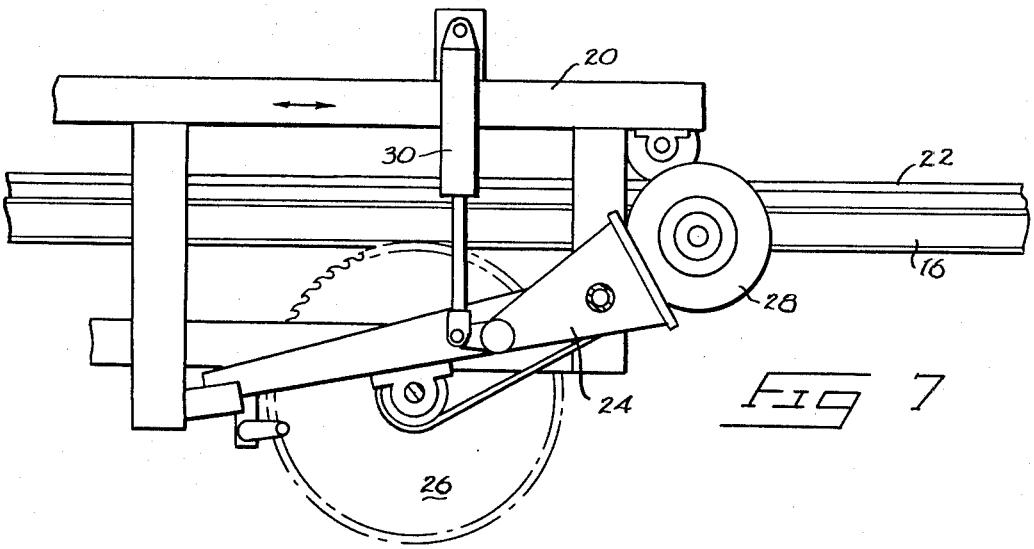
FIG. 7 is an enlarged schematic view of a main saw assembly mounted on a overhead saw carriage.

The log sawing apparatus 10 has a general frame 16 for supporting the various components. The apparatus 10 is designed to cut the log into various boards at a log sawing station identified with the numeral 18. The apparatus 10 includes a saw carriage 20 that moves in a longitudinally reciprocating path back and forth past the log sawing station 18. The carriage 20 is supported on an overhead track 22. The saw carriage 20 supports a main saw assembly 24 (FIG. 7) having a main saw 26 mounted thereon for cutting the log. A drive motor 28 (FIG. 2) is mounted on the saw assembly 24 for rotating or driving the main saw 26. The saw assembly 24 includes means 30 (FIG. 7) for lowering the saw 26 from an elevated position to a lowered position for sawing the log and for raising the main saw 26 to an elevated position when the saw is not being utilized. In a preferred embodiment the main saw 26 is mounted in a vertical sawing plane identified with the letter "A" (FIGS. 1, 2,9*a*–*b*).

Figure 8:
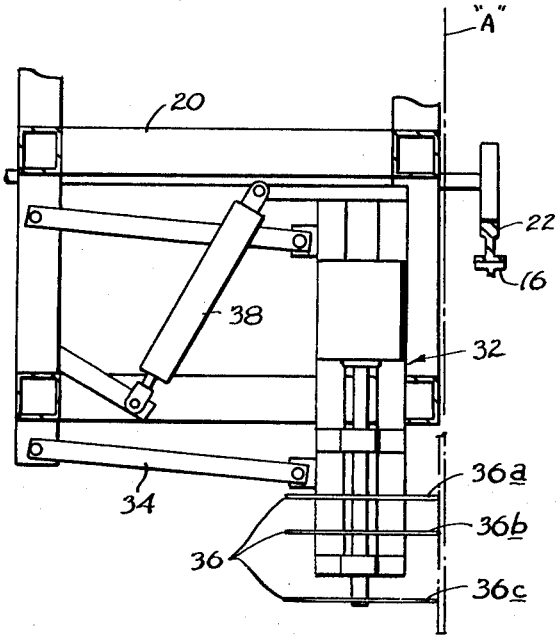
FIG. 8 is an enlarged schematic view of an edge saw assembly mounted on the overhead saw carriage.

An edger assembly 32 (FIG. 8) is mounted on the saw carriage 20 for cutting the log in two parallel planes normal to the vertical sawing planz "A". The edger assembly 32 includes a parallelogram support frame 34 that is mounted on the saw crriage 20 to enable edger saws 36*a*, 36*b* and 36*c* to be lowered into position for cutting the log along horizontal planes normal to the vertical sawing plane "A". The edge saws 36 are spaced so that one of two different edger cuts may be selected. For example, it may be desirable to cut a four inch board in which case, edger saws 36*a* and 36*b* would be brought into position to cut the four inch cut. If a six inch cut is desired, edger saws 36*b* and 36*c* are brought into position to cut the six inch board. The edger saws 36 are raised and lowered by drive means 38. Drive means 38 is capable of raising the edger saws 36 to an inoperative elevated position when not being utilized and for lowering the edger saws 36 into one of the two positions to cut either the four inch or six inch width boards.

Figure 2:
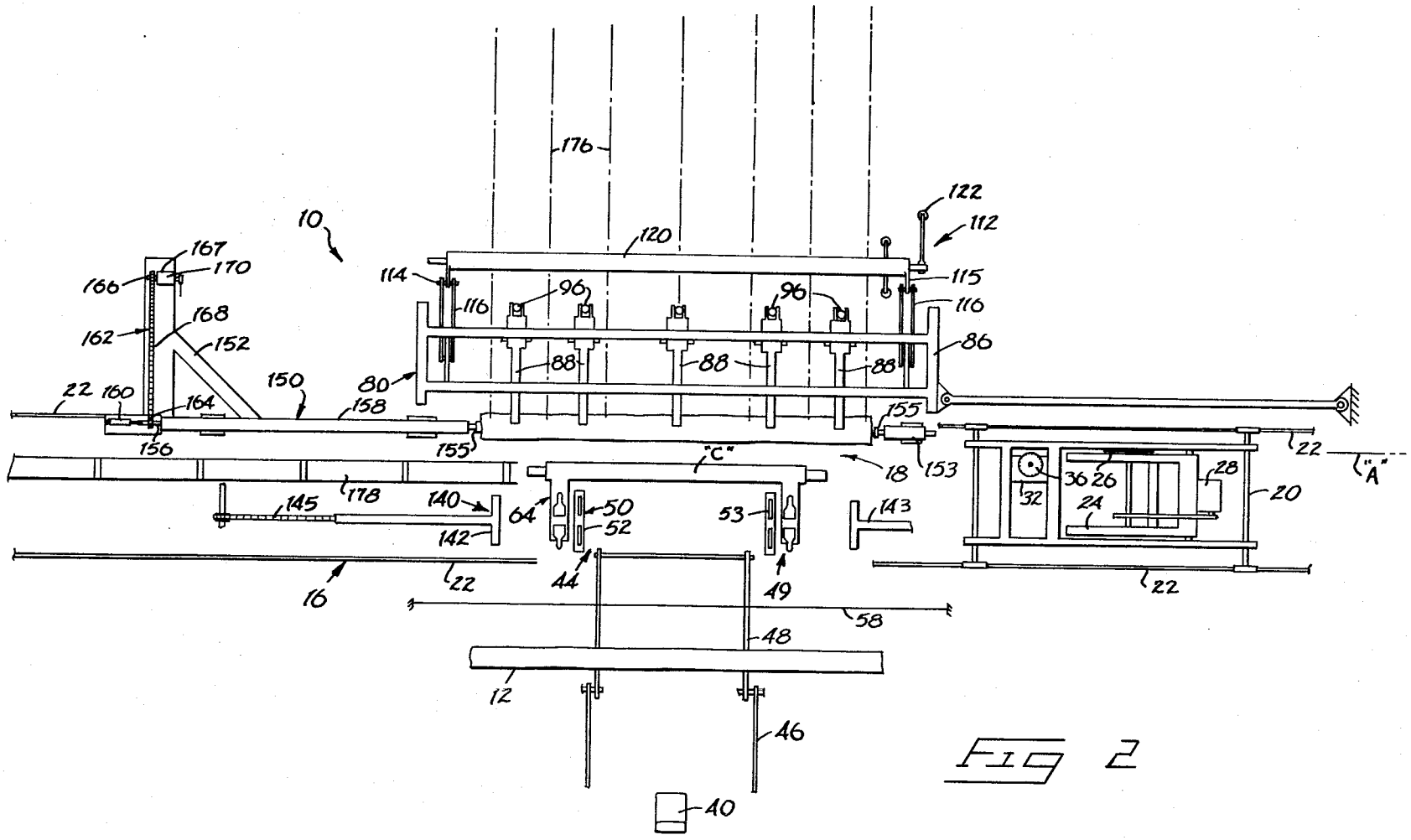
FIG. 2 is an overhead schematic view of the log sawing apparatus illustrated in FIG. 1.

The log sawing apparatus 10 is designed to be operated by a single operator positioned at an operator's station 40 (FIGS. 1 and 2). The apparatus 10 additionally includes an orientation station 44 intermediate the operator station 40 and the log sawing station 18 for enabling the operator to prealign or orient the log for an opening face cut.

The logs 12 are sequentially brought to the apparatus by an infeed covenyor 46 that includes a separating conveyor 48 for advancing one log at a time to the orientation station 44. In a preferred embodiment the sepatation conveyor 48 is in the form of a "jack ladder" conveyor. At the orientation station 44 the operator views the log's profile to analyze the various possible cuts to obtain the maximum desirable lumber from the log.

Figure 6:
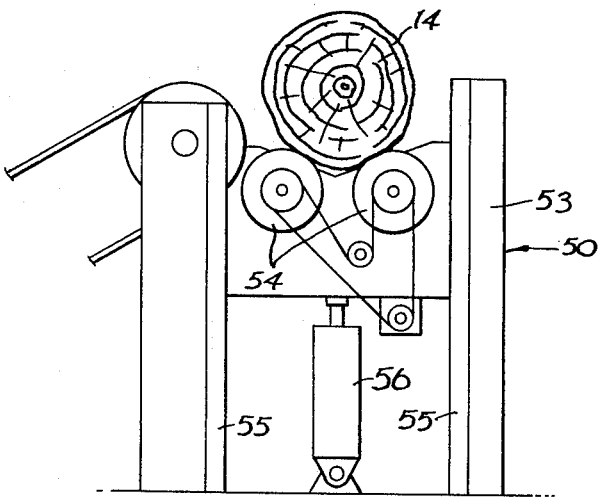
FIG. 6 is an enlarged schematic side view of an alignment mechanism for supporting, rotating, raising and lowering the log to prealign the log in relation to a reference plane at the orientation station.

Specifically, the apparatus 10 includes a first log alignment means 49 for enabling the operator to orient and align the log with respect to a first alignment plane (FIG. 1) identified with the letter "B". The first log alignment means 49 includes means 50 (FIGS. 2 and 6) for supporting and rotating the log. Means 50 includes two log rotating assemblies 52 and 53 mounted at spaced longitudinal locations at the orientation station 44. One of the log rotating assemblies 53 is illustrated in FIG. 6 and depicts wheels 54 that are rotated in unison to support and rotate the log at the orientation station 44. The log rotating assemblies 52, 53 are mounted in vertical guides 55 to enable the assemblies 52, 53 to be raised and lowered.

The first log alignment means 49 includes means 56 for raising and lowering the assemblies 52 and 53 either individually or in unison to individually raise and lower either end 13, 14 of the log or to raise and lower both ends 13, 14 in unison. The operator has manipulative control over means 50 and 56 to rotate and raise and lower the log as desired so that the operator may obtain an objective view of the entire profile of the log.

The apparatus 10 further includes a first overlay grid 58 (FIGS. 1 and 3) that is effectively projected onto the log at the orientation station 44 to form an overlay grid pattern image to enable the operator to efficiently make decisions concerning the opening face cut of the log and other cuts parallel with the opening face cut. The first overlay grid 58 is designed to provide a line of vision between the operator and the log coincident with the first reference plane "B". In a preferred embodiment, the first overlay grid 58 includes a plurality of vertically spaced horizontal wires 62 that are positioned between the operator station 40 and the orientation 44 so that when the operator looks at the log 12, the operator sees the log through the wires 62 to form the superimposed grid image.

In a preferred embodiment, the wires 62 are equally spaced from each other a selected distance so that the wire images projected onto the log have image lines approximately two inches apart. Such image lines enable the operator to visually perceive the cuts that could be made at two inch intervals. The operator then raises or lowers the log and rotates the log to obtain the maximum utilization. In most situations the operator will rotate the log so that the sweep of the log is parallel with the first alignment plane "B" or is at 90° thereto. The operator may position the log so that an outer profile surface of the log is substantially parallel with the plane "B"or the operator may desire to position the log so that the axis of the log is substantially parallel with the first alignment plane "B". While the log is at the orientation station, the operator determines the opening face cut of the log and orients the log with the opening cut parallel with the first alignment plane "B". Once the open cut is determined and the log oriented with the face cut parallel with the reference plane "B", the log in effect is aligned with a first log reference plane that extends through the length of the log intersecting the ends of the log. The first log reference plane is parallel to the opening cut and parallel with all cuts made in the first and third side of the log. The opening face cut determines the first side of the log. The third side is the side opposite to the first side.

After the first log reference plane has been established, the operator is ready to have the log 12 moved from the orientation station 44 to the log sawing station 18.

The log sawing apparatus 10 includes a log loading means 64 for grasping the log at the orientation station and for moving the log to the log sawing station 18. The log loading means 64 pivots the log so that the log is delivered to the log sawing station 18 with the first log reference plane and the opening face cut parallel with the vertical sawing plane "A". In a preferred embodiment, the log loading means 64 delivers the log to the log sawing station 18 with the first log reference plane coincident with the sawing plane "A" so that a cut could be made along the first log reference plane.

Figure 3:
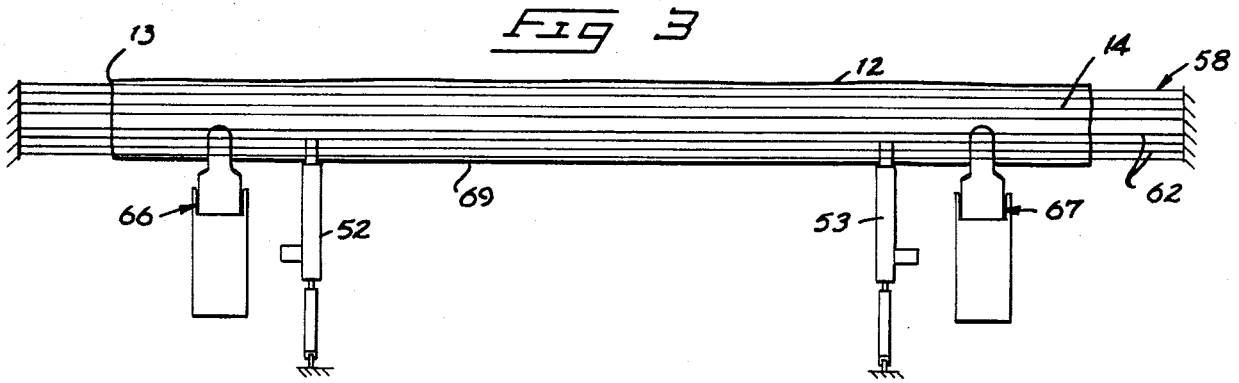
FIG. 3 is a schematic front view of a log orientation station with a grid pattern superimposed on the log to enable the operator to align the log in a first reference plane.
Figure 5:
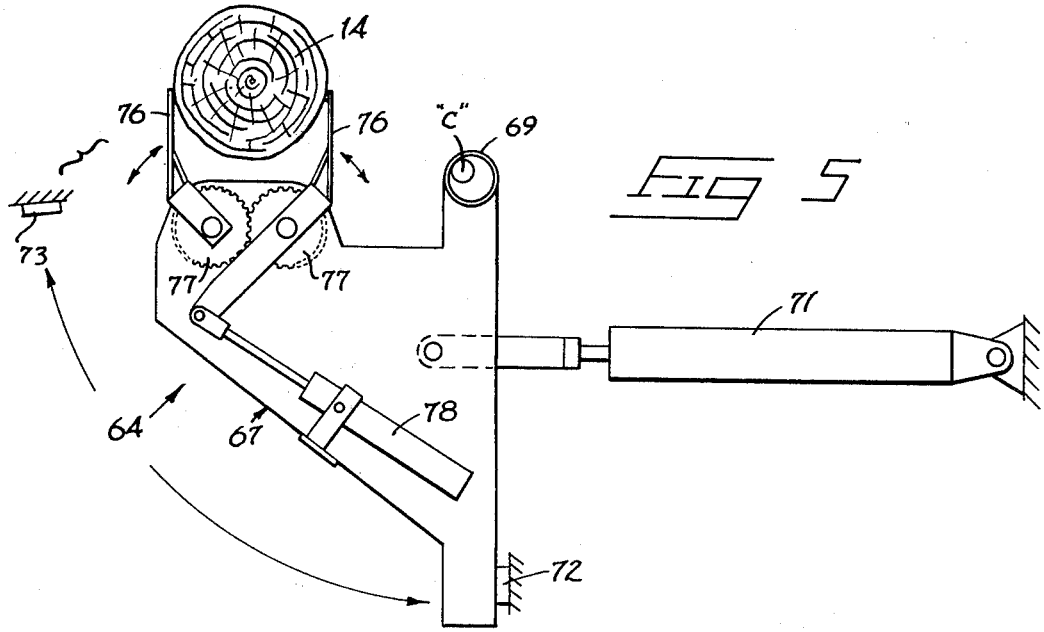
FIG. 5 is an enlarged schematic side view of a log-loading mechanism for grippling a log and transferring the log from the orientation station to a log sawing station.

The log loading means 64 is illustrated in more detail in FIGS. 3 and 5 and includes grapple assemblies 66 and 67 which are interconnected by a shaft 69 that pivots about an axis "C". The log loading means 64 includes a drive means 71 for pivoting the grapple assemblies 66, 67 between a stop 72 and a stop 73. The angular displacement of the grapple assemblies 66, 67 between the stops 72 and 73 moves the log into the log sawing station 18 with the first log reference plane coincident to the sawing plane "A". Each of the grapple assemblies 66, 67 include a pair of grapple arms 76 that are pivotally mounted for releasably gripping the ends 13, 14 of the log. The grapple arms are interconnected through gears 77 so that the arms move in unison when driven by an actuator 78.

Figure 10:
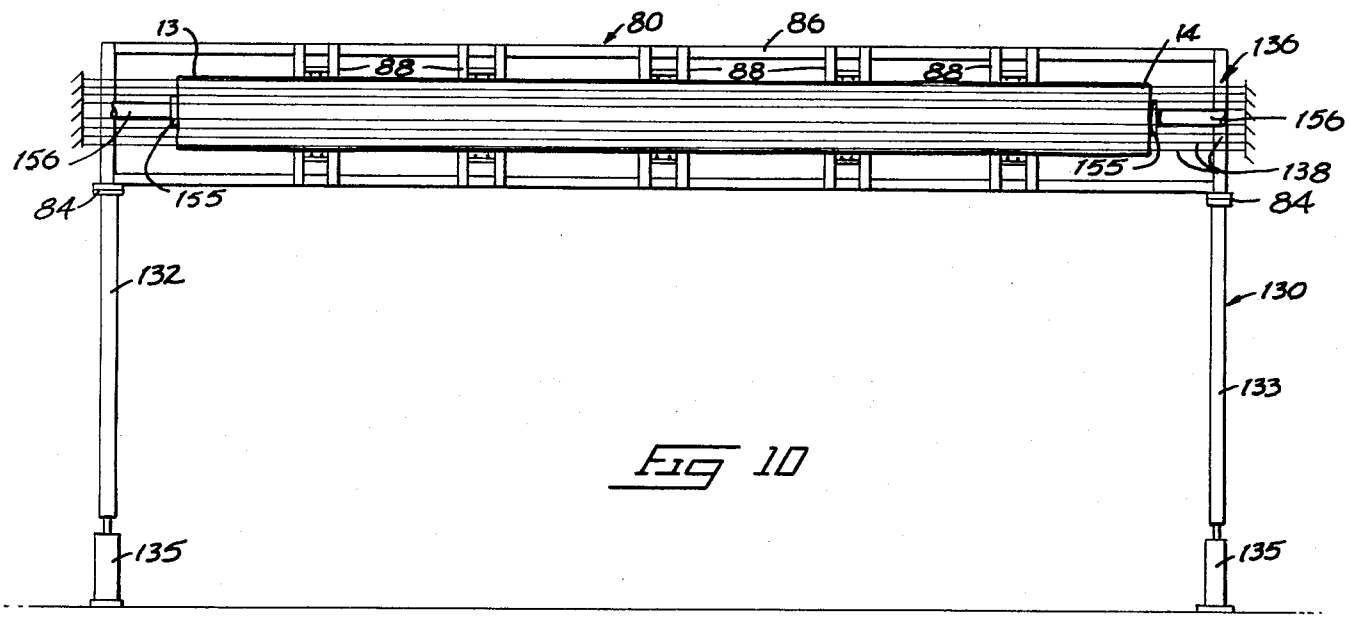
FIG. 10 is an enlarged schematic front view of the log sawing station with a grid pattern superimposed on the log to enable the operator to align the log in a second reference plane.

The apparatus 10 further includes a log holding means 80 (FIGS. 1, 2 and 10) at the log sawing station 18 for receiving the log 12 from the log loading means 64. The log holding means 80 includes support frame means having tracks 84 for supporting an elongated frame 86. The elongated frame 86 extends substantially parallel with the vertical sawing plane "A". Elongated frame 86 is capable of moving laterally on the tracks 84 with respect to the cutting plane "A" to incrementally feed the log into the sawing plane "A".

Figure 4:
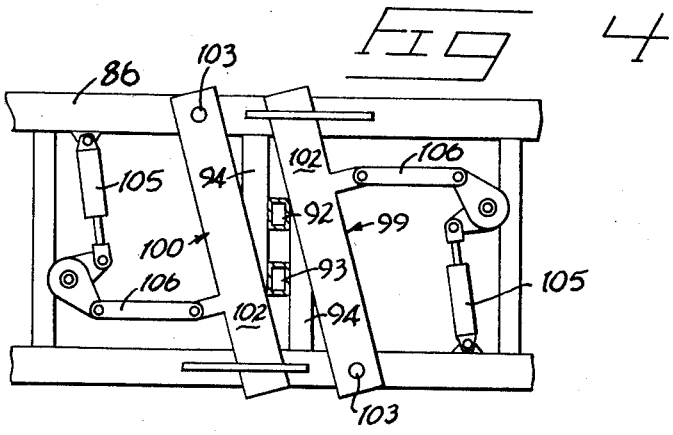
FIG. 4 is an enlarged schematic front view of a mechanism for locking gripping arms in a closed position.

Log grippling means 88 are mounted on the log holding mens 80 for gripping the log at several locations along the length of the log while the log is being cut in the sawing plane "A". Each of the gripping element assemblies 90 includes a pair of gripping arms or dogs 92, 93 that move vertically in opposition to each other along vertical guides 94 (FIG. 4). An actuator 96 is connected to the gripping arms 92, 93 for pivoting the girpping arms between open and closed positions. The gripping arms 92, 93 are pivotally mounted on the frame 86 with the actuator 96 attached to the arms so that the gripping arms 92, 93 are automatically self seeking to grip the log wherever the log is positioned at the sawing station.

The log holding means 80 further includes locking means 98 (FIG. 4) for locking the gripping arms 92, 93 in the closed position to cause the gripping arms 92, 93 to hold the log stationary and to firmly grip the log and prevent the log from falling or moving while the log is being sawn. The locking means 98 includes a pair of friction lock assemblies 99 and 100 for respectively engaging each pair of the gripping arms 92 and 93 to hold the gripping arms in a locked position. Each of the friction locking assemblies 99, 100 includes a bar 102 that is mounted for pivotal movement about axis 103. Actuator 105 is operatively connected to the bar 102 through a linkage 106. The bar 102 is mounted at a relatively small acute angle with respect to the path of the gripping arms 92 and 93 so that the resulting frictional forces prevent the arms 92, 93 from opening and to maintain a positive closing force on the arms 92, 93 to firmly squeeze the log between the arms with a constant positive pressure.

The log sawing apparatus 10 further includes a lateral positioning means 112 (FIGS. 1 and 2) that is operatively connected to the holding means 80 for moving the log holding means 80 laterally with respect to the longitudinal path of the saw carriage 20. The lateral positioning means 112 incrementally feeds the log laterally into the path of the vertical sawing plane "A" to progressively cut the log into a desired number of boards. The lateral positioning means 112 includes crank assemblies 114 and 115 that are connected to the elongated frame 86 by arms 116. Each crank assembly 114, 115 includes a bell crank 118 that is connected through a connecting tube 120 (FIG. 2) so that the bell cranks 118 are operated in unison. A drive means 122 is connected to one of the bell cranks to pivot the bell cranks 118 about the axis of the tube 120 to move the arms 116 forward and back to move the elongated frame 86 toward and away from the sawing plane "A".

A linear sensor 124 (FIG. 1) is utilized to control the movement of the drive 122 in accordance with preset instructions by the operator. The desired distance is sensed by the linear sensor 124. Frequently the linear sensor 124 is preprogrammed to measure movements of two inch intervals.

The log sawing apparatus 10 includes a second log alignment means 130 (FIGS. 1 and 10) for assisting the operator in aligning the log at the log sawing station 18 in relation to a second alignment plane "D" (FIG. 1) which is normal to the vertical sawing plane "A". The second log alignment means 130 is capable of raising and lowering the log or raising and lowering one end with respect to the other. The second log alignment means 130 includes elevator assemblies 132 ad 133 that support the tracks 84. The elevator assemblies 132 and 133 support the elongated frame 86 adjacent its ends. Each of the elevator assemblies 132, 133 have individualy operated actuators 135 for raising and lowering the elevator assemblies 132 and 133 to respectively lower or raise ends of the elongated frame 86.

The log sawing apparatus 10 further includes a second overlay grid 136 that is intermediate the operator station 40 and the log sawing station 18. The grid effectively projects a grid image onto the log at the log sawing station 18 to assist the operator in raising and lowering the log or raising and lowering the ends of the log to align the log with respect to the second alignment plane "D". The second overlay grid 136 establishes a line of vision between the operator and the log which is coincident with the second alignment plane "D" to enable the operator to clearly visualize the location of the second alignment plane "D"with respect to the log. Preferably the second overlay grid 136 includes a plurality of vertically spaced horizontal wires 138 positioned between the operator station 40 and the log sawing station 18. From the operator station 40 the wires appear to project parallel horizontal lines onto the log at vertically spaced intervals. Preferably the wires are spaced sufficiently so that the project lines onto the log would be vertically spaced approximately at two inch intervals so that the operator can make a decision as to the best way to cut the log in the direction that is normal to the opening cut or the first log reference plane. Alternatively the grid pattern may be projected onto the log by various light projection means or by use of a cathode ray tube having lines superimposed on an image of the log.

After the operator adjusts the log up and down to a desired location, a second log reference plane is established that extends through the log ends in which the first log reference plane is normal to the second log reference plane. The intersection of the first and second log reference planes establish a cutting axis "E" that is parallel to each surface to be cut from the log.

The log sawing apparatus 10 further includes a centering means 140 (FIG. 2) that is located at the orientation station 44 for centering the log longitudinally so that the ends 13 and 14 of the log are substantially equal distance from the center of the cutting station 18. The centering means 140 includes opposed pushers 142 and 143 that are interconnected by chain linkage 145 to cause the pushers 142 and 143 to move in unison towards each other and against the ends of the log to center the log with respect to the sawing station 18.

The log sawing apparatus 10 includes a log rotating means 150 (FIG. 2) at the log sawing station 18 for rotating the log either 90°or 180°. The log rotating means 150 includes opposed mirror image chuck carriages 152 and 153 (FIG. 2) that are positioned adjacent opposite ends of the elongated frame 86 (only one is shown in detail). Each of the chuck carriages 152, 153 are mounted fcr movement parallel with the vertical sawing plane "A". Each chuck carriage 152, 153 includes a log end gripping chuck 155 that is designed to engage the end of the log along an axis defined by a chuck shaft 156. The chuck shaft 156 is elongated and is rotatably mounted in a tube 158. The shaft 156 is mounted in the tube 158 for longitudinal movement with respect to the chuck carriage 152, 153 and for rotational movement with respect to the tube 158 for rotating the log 90°or 180°. Each chuck carriage 152, 153 includes a shaft actuator 160 for moving the shaft 156 longitudinally to force the chuck 155 firmly into the ends 13, 14 of the log. The chuck carriages 152, 153 are initially set with the chucks 155 a very short spaced distance from the end of the log. When it is desired to engage the log, the actuator 160 is energized to move the chuck 155 a short distance firmly into engagement with the end of the log.

The rotating means 150 includes a shaft rotating means 12 that includes a sprocket 164 mounted on the shaft 156 and a corresponding sprocket 166 mounted on a drive shaft 167. A chain 168 interconnects the sprockets 164 and 166. The sprockets 164 and 166 are sufficiently spaced so that the shaft 156 is able to move longitudinally approximately three to six inches without affecting the ability of the chain to rotate the shaft 156. The drive shaft 167 is conncted to a rotary hydraulic motor 170 that is programmable to rotate the shaft 156 either 90°or 180°at any one time. The log rotating means 150 is capable of rotatiing the log to position either the first or second log reference plane into position parallel with the vertical sawing plane "A".

The log sawing apparatus 10 includes a lateral outfeed conveyor 176 (FIG. 1) that is located at the log sawing station 18 for receiving boards that have been cut from the log and transporting the boards laterally underneath the log holding means 80 to a desired location for further processing. Additionally, the log sawing apparatus 10 includes a longitudinal outfeed conveyor 178 that is positioned at the log sawing station 18 for moving material cut from the log longitudinally with respect to the path of the carriage 20. A deflector 180 (FIG. 1) is positioned beneath the path of the saw carriage 20 for deflecting the boards or cut material either onto the lateral outfeed conveyor 176 or onto the longtiudinal outfeed conveyor 178.

Figures 9, 9A, 9B, 9C, 9D, 9E, 9F, 9G, 9H:
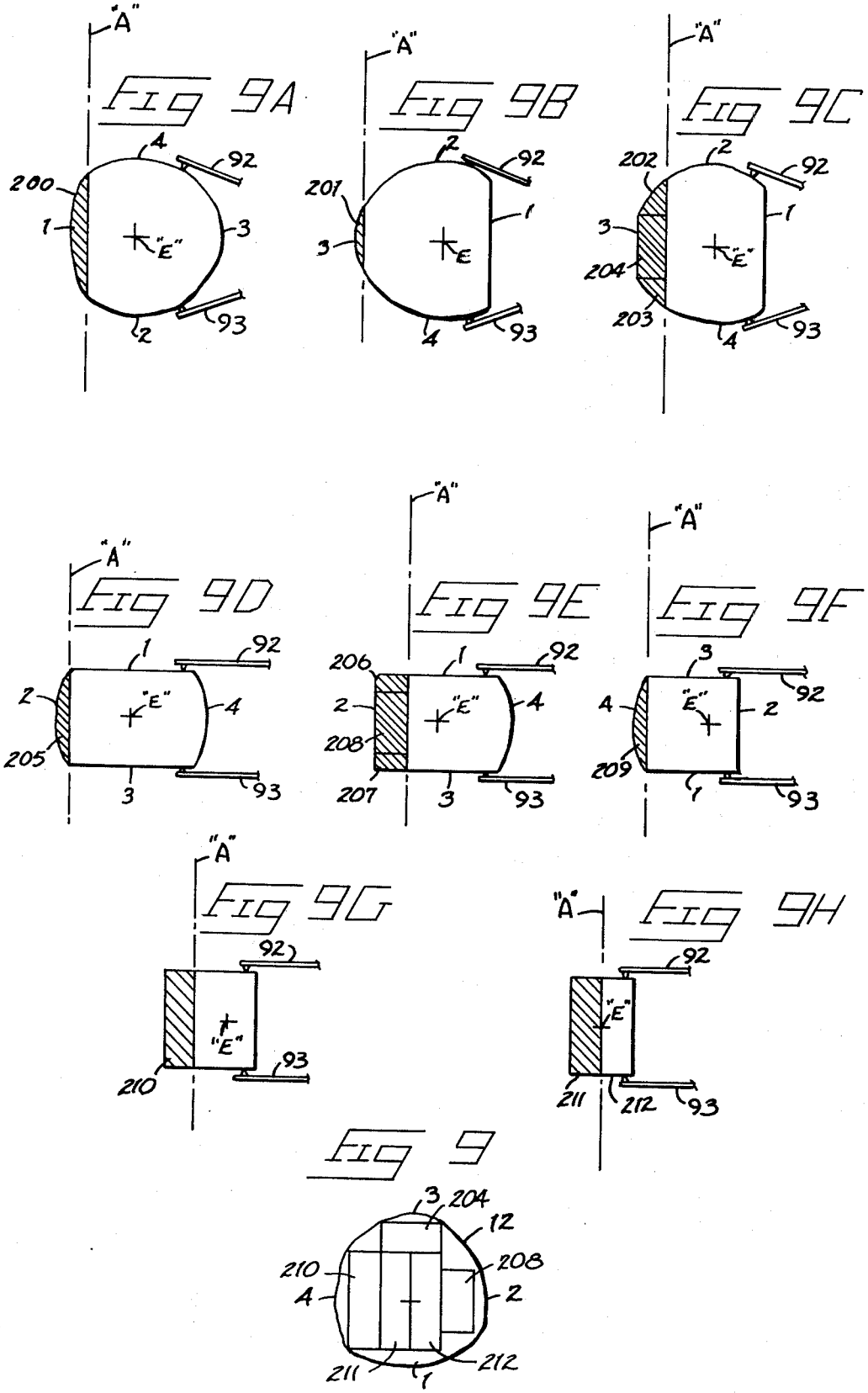
FIG. 9 illustrates a cross section of a log that is lined showing boards that are to be cut from the log.
FIGS. 9*a* through 9*h* show a sequence of views illustrating how the log is cut into the various boards that are illustrated in FIG. 9.

The operation of the log sawing apparatus 10 will be described in reference to FIGS. 9 and 9*a–h*. FIG. 9 is a schematic view of the cross section of the log 12 illustrating the boards to be cut from the log. For purposes of illustrating the log will be defined as having sides 1, 2, 3 and 4 which are numbered about the log axis. At the log orientation station 44, the operator manipulates controls to activate the first log aligning means 49 to rotate and adjust the ends of the log up and down with respect to the first a alignment plane "B" and the first overlay grid 58. Such alignment is generally influenced by the sweep of the log. It is frequently desirable to position the logs so that the sweep of the log is either parallel or normal to the first alignment plane "B". The first overlay grid enables the operator to visually project onto the log lines indicating possible cuts in the log that are parallel with the first log reference plane.

After the log has been centered and prealigned, the operator activates the log loading means 64 to pivot the log upward and laterally to the log sawing station 18. At the log sawing station 18, the log gripping means 88 are activated to close onto the log and firmly secure the log to the elongated frame 86. As the log is pivoted upward and inward to the log sawing station 18, the first log reference plane established at the orientation station is placed parallel with the vertical sawing plane "A". In a preferred embodiment the log reference plane is initially positioned coincident with the vertical saw plane "A".

The lateral positioning means 112 is then activated to the log holding means 80 rearward approximately three inches to make the first opening cut in side 1 as illustrated in FIG. 9*a*. The log carriage 20 is then activated to move the saw assembly 24 past the log sawing station 18 to make the opening cut and remove slab 200 from side 1. The operator then activates the log rotating means 150 to cause the actuators 160 to drive the chucks 155 into the ends of the log. After the log is firmly gripped between the chucks 155, the actuators 96 and 105 are operated to open the gripping arms 92, 93 (dogs) to release the log to the rotating mean a 150. The rotary hydraulic actuator 170 is then actuated to rotate the shafts 156 and the log 180° to bring side 3 into sawing position (FIG. 9*b*). The actuators 96 and 105 are then actuated to bring the gripping arms 92, 93 into firm engagement with the log to secure the log to the elongated frame 86 preparatory to sawing side 3. The actuator 160 is then operated to move the chucks 155 out of engagement with the ends of the logs. The lateral positioning means 120 is then activated to move the log laterally in which the log reference plane is approximately five inches from the sawing plane "A" to saw side 3 and remove slab 201. The deflector 180 is generally operated to cause the slabs 200 and 201 to fall onto the longitudinal outfeed conveyor 178. Under some occasions it may be desirable after each cut to activate means 30 to raise the saw 26 during each return stroke so that the log may be manipulated while the carriage is being returned. However, this is an optional feature.

After the slab 201 is removed, the lateral positioning means 112 drives the log holding means 80 forward two inches to position side 3 for a second cut illustrated in FIG. 9*c*. As this point, the operator activates means 38 for moving the edger saws 36*a* and 36*b* into position to cut slab pieces 202 and 203 and cut a 2×4 board 204 in conjunction with the main saw. After such a cut, a flitch is formed with sides 2 and 4 remaining to be cut. At this point, the operator views side 3 through the second overlay grid 136 to determine what cuts should be made 90° to sides 1 and 3. In this hypothetical situation the operator determines that the flitch may be cut to obtain three 2×6's and one 2×4. The operator then activates the second log alignment means 130 to raise or lower the ends of the log to position the log with respect to a second log alignment plane "D". When the desired alignment is obtained, then the log has a second imaginary reference plane that is normal to the first reference plane in which the interception of the two planes define the cut axis "E" for the log.

The lateral positioning means 112 is then activated to move the log laterally to position the cut axis "E" coincident with the axis defined by the shafts 156. The log rotating means 150 is activated utilizing the actuator 160 to drive the chucks 155 into the ends of the log. After this is accomplished, the log gripping means 88 is activated to release the gripping jaws92, 93 and release the log. The rotary hydraulic actuator 170 then is operated to rotate the log 90° to position side 2 for cutting. The log gripping means 88 is then activated to again grip the log and the log rotating means is deactivated to remove the chucks 155 from the ends of the log. The lateral positioning means 112 is then activated to move the log laterally to position the cut axis "E" approximately four inches from the vertical sawing plane "A" . The saw carriage is then operated to move the saw 26 past the sawing station 118 to cut away slab 205.

The lateral positioning means 112 is then activated to move the log laterally forward a two inch increment to position the cut axis "E" approximately two inches from the vertical sawing plane "A". As shown in FIG. 9*e*, the edger saws 36*a* and *b* are then lowered to cut slab elements 206 and 207 and a 2×4 board 208.

After the wood parts 206, 207 and 208 are removed, the lateral positioning means moves the log holding means 80 rearward to position the cut axis "E" coincident with the rotating chucks 155. The log rotating means 150 is then activated to drive the chucks 155 again into the end of the log. The log gripping means 88 is deactivated to release the gripping arms and permit the rotating hydraulic actuator 170 to rotate the log 180° to the position illustrated in FIG. 9*f* to present side 4 for cutting. The log gripping means 88 is then activated to firmly grip the flitch and the log rotating means 150 is deactivated. The saw carriage is then activated to move the saw past the sawing station 18 to cut the slab 209 from the flitch generating a cant as illustrated in FIG. 9*f* . After the slab 209 has been removed, the lateral positioning means 112 is incremented in two separate steps laterally to cut the three 2×6's 210, 211, 212 as illustrated in FIGS. 9*g* and 9*h*. The deflector 180 is preferably operated to cause the 2×6 boards 210–212 to fall onto the lateral outfeed conveyor 176.

One can appreciate the efficiency of which a single operator can affectively cut the entire log at the single log sawing station 18 into a number of structural boards depending upon the size and configuration and profile of the log. The overlaid or superimposed grids 58 and 136 enable the operator to obtain maximum wood utilization without expensive log scanning equipment.

It should be understood that the above described emobdiment of the applicant's invention is merely illustrative of the principles of his invention and that numerous other embodiments may be readily devised without deviating therefrom. Only the following claims are intended to define or limit his invention.

What he claims is:

1. Apparatus for sawing a log into one or more timbers having rectangular cross sections, comprising:

a sawing station;

a frame at the sawing station;

a saw carriage mounted on the frame for reciprocating movement along a longitudinal path past the sawing station;

a saw mounted on the carriage for movement therewith with the saw being aligned to saw a log lengthwise in a prescribed sawing plane;

a first log aligning means at an orientation station for receiving a log and adjusting the orientation of the log to align the log with respect to a first alignment plane with the first alignment plane extending through the log ends defining a first log reference plane;

a log loading means for transferring the aligned log from the orientation station to the sawing station and positioning the log at the sawing station with the first log reference plane parallel with the prescribed sawing plane to enable the saw to initially cut the log parallel with the first log reference plane;

a log holding means at the sawing station for releasably gripping and holding the aligned log stationary while the log is being cut;

a second log aligning means at the sawing station for subsequently adjusting the orientation of the log to further align the log with respect to a second alignment plane that is normal to the prescribed sawing plane with the second alignment plane extending through the log ends defining a second log reference plane that is normal to the first log reference plane;

log rotating means at the sawing station for rotating the log 90° when the log holding means releases the log to position the log with the second log reference plane parallel to the prescribed sawing plane to enable the saw to subsequently cut the log parallel with the second log reference plane normal to the second cut;

lateral positioning means operatively connected to the log holding means for selectively moving the held log laterally with respect to the longitudinal path to enable the saw to cut the log at selected distances from one of the log reference planes; and drive means operatively connected to the saw carriage for moving the carriage back and forth along the longitudinal to sequentially saw the log into one or more timbers having a rectangular cross section.

2. The log sawing apparatus as defined in claim 1 wherein the orientation station is spaced laterally from the longitudinal path and wherein the prescribed sawing plane is vertical and wherein the first alignment plane is angularly spaced from the sawing plane, and wherein the log loading means has means for laterallly moving the aligned log from the orientation station to the sawing station and angularly rotating the aligned log to position the first log reference plane parallel with the vertical sawing plane.

3. The log sawing apparatus as defined in claim 1 wherein the first log aligning means includes a first means for selectively rotating the log and a second means for raising or lowering each end of the log to align the log with respect to the first alignment plane.

4. The log sawing apparatus as defined in claim 1 further comprising:

a first overlay grid for effectively projecting a first grid pattern onto the log at the orientation station with the first grid pattern defining the first alignment plane and a first set of selectable parallel cut planes progressively spaced from the first alignment plane at the selected distances.

5. The log sawing apparatus as defined in claim 4 wherein the first log alignment means includes a first means for selectively rotating the log and a second means for raising or lowering each end of the log to align the log with the first grid pattern.

6. The log sawing apparatus as defined in claim 4 further comprising a second overlay grid means for effectively projecting a second grid pattern onto the log at the sawing station with the second grid pattern defining the second alignment plane and a second set of selectable parallel cut planes progressively spaced from the second alignment planes and normal to the first set of selectable cut planes at the selected distances.

7. The log sawing apparatus as defined in claim 6 wherein the second log aligning means includes means for raising or lowering the ends of the log at the sawing station to align the log in relation to the second grid pattern.

8. The log sawing apparatus as defined in claim 1 wherein the log rotating means includes opposed chuck means for gripping the log by its ends and for rotating the log about an axis parallel with and spaced from the sawing plane and wherein the lateral positioning means is operatively connected to the log holding means to move the log laterally in one direction to position the log between the opposed chucks preparatory to rotating the log and to move the log laterally in the other direction to position the log in the sawing plane.

9. The log sawing apparatus as defined in claim 1 further comprising an edger assembly mounted on the saw carriage for movement therewith and wherein the edger assembly includes spaced edger saws and means for moving the edger saws to an operative position to cut the log normal to the prescribed sawing plane and for moving the edger saws to an inoperative position.

10. The log sawing apparatus as defined in claim 4 wherein the first grid means includes a plurality of vertically spaced horizontal wires located between an operator's station and the orientation station with the wires corresponding with the first set of selectable cutting planes to enable an operator to select cuts parallel with the first alignment plane.

11. The log sawing apparatus as defined in claim 10 wherein the first log alignment means includes means for selectively rotating, raising and lowering the log with respect to the horizontal wires to orient and align the log with respect to the first alignment plane in preparation for an opening cut and subsequent parallel cuts.

12. The log sawing apparatus as defined in claim 6 wherein the second overlay grid means includes a plurality of vertically spaced wires located between an operator's station and the sawing station with the wires corresponding with the second set of selectable cutting planes to enable an operator to select desired cuts parallel with the second alignment plane.

13. The log sawing apparatus as defined in claim 1 wherein the log rotating means includes chuck means for gripping the ends of the log and indexing means operatively connected to the chuck means for selectively rotating the log in increments of 90° or multiples thereof.

14. The log sawing apparatus as defined in claim 1 wherein the log holding means includes (1) a plurality of releasable log gripping elements positioned on a log holding frame at longitudinally spaced locations for holding the aligned log stationary while the log is being cut by the saw and for releasing the log after the log is cut to enable the log rotating means to rotate the log, and (2) releasable frictional locking means adjacent the log gripping elements for engaging and maintaining the gripping elements secured to the log until the frictional locking means are released.

15. The log sawing apparatus as defined in claim 1 wherein the log holding means includes a plurality of releasable log gripping means positioned on an elongated log holding frame, and wherein the second log alignment means has elevating means for raising and lowering the ends of the elongated log holding frame to align the log with respect to the second alignment plane.

* * * * *